US005429733A

United States Patent [19]

Ishida

[11] Patent Number: 5,429,733

[45] Date of Patent: Jul. 4, 1995

[54] PLATING DEVICE FOR WAFER

[75] Inventor: Hirofumi Ishida, Kanagawa, Japan

[73] Assignee: Electroplating Engineers of Japan, Ltd., Tokyo, Japan

[21] Appl. No.: 56,488

[22] Filed: May 4, 1993

[30] Foreign Application Priority Data

May 21, 1992 [JP] Japan ..... 4-152985

[51] Int. Cl.[6] ..... C25D 17/06

[52] U.S. Cl. ..... 204/224 R; 204/297 R; 204/297 M; 204/279

[58] Field of Search ..... 204/224 R, 297 R, 297 M, 204/297 W, 279; 118/503

[56] References Cited

U.S. PATENT DOCUMENTS

| | | | |
|---|---|---|---|
| 3,835,017 | 9/1974 | Mentone et al. | 204/224 R |
| 4,137,867 | 2/1979 | Aigo | 118/627 |
| 4,170,959 | 10/1979 | Aigo | 118/627 |
| 4,339,319 | 7/1982 | Algo | 204/224 R |
| 4,428,815 | 1/1984 | Powell et al. | 204/297 W |
| 4,605,483 | 8/1986 | Michaelson | 204/297 R |
| 4,861,452 | 8/1989 | Stierman et al. | 204/297 |
| 4,874,476 | 10/1989 | Stierman et al. | 204/15 |
| 4,931,149 | 6/1990 | Stierman et al. | 204/15 |
| 5,000,827 | 3/1991 | Schuster et al. | 204/15 |
| 5,024,746 | 6/1991 | Stierman et al. | 204/297 |
| 5,294,257 | 3/1994 | Kelly et al. | 118/503 X |

FOREIGN PATENT DOCUMENTS

| | | | |
|---|---|---|---|
| 56-5318 | 2/1981 | Japan | C25D 5/02 |
| 57-159029 | 10/1982 | Japan | H01L 21/306 |
| 60-231330 | 11/1985 | Japan | H01L 21/306 |
| 238472 | 3/1990 | Japan | C25D 7/12 |
| 2122067 | 10/1990 | Japan | C25D 5/08 |
| 31970 | 1/1991 | Japan | C25D 5/08 |

*Primary Examiner*—Donald R. Valentine

*Attorney, Agent, or Firm*—Michael D. Bednarek; Marks & Murase

[57] ABSTRACT

A plating device for a wafer employs an air bag 6, 20 as a holding means for downwardly depressing the wafer 8 upon performing plating on the wafer 8. The air bag 6, 20 constrain only the upper surface 13 of the circumferential edge of the wafer at an expanded state and releases the constraint by contracting to restore an initial configuration at a non-expanded state. By this, the holding means will not occupy the upper side space of the wafer both during plating process and during non-plating process so as to avoid adhering of dust and foreign matter onto the wafer 8.

6 Claims, 2 Drawing Sheets

PLATING DEVICE FOR WAFER

BACKGROUND OF THE INVENTION

1. Field of the Invention

The present invention relates to a plating device for a wafer.

2. Description of the Related Art

This type of device is adapted to position a wafer in horizontal state and to perform plating by injecting a plating fluid from the lower side onto the lower surface of the water. Conventionally, the wafer is depressed from the upper side by means of a holding means during plating process in order to support the water against the pressurized plating fluid injected from the lower side, to assure contact of the wafer with a cathode electrode and for other purposes (see Japanese Utility Model Laid-Open Publications Nos. 2-38472 and 2-122067 and U.S. Pat. Nos. 4,137,867 and 4,170,959 and so forth).

Therefore, in the conventional water plating device, a depression disc connected to a pressure cylinder or a depression means commonly used as a cathode electrode are inherently required. This equipment is positioned above the wafer during the plating process to occupy the upper side space. Since such plating devices are often employed in combination with a transporting robot apparatus for setting and removing the water, the device must have a construction and operation that permits movement of, the equipment including the depression means positioned in the upper side space of the plating device, to another position every time of setting and removing of the wafer by the transporting robot in order to avoid interface with the transporting robot.

SUMMARY OF THE INVENTION

On the other hand, it is desired to perform plating of the wafer in an environment as clean as possible. To achieve this, it requires an effort for eliminating situations where dust and other foreign matters may adhere on the wafer, as much as possible. The inventor has studied the conventional devices in view of this and, as a result, found that amount of dust and other foreign matters adhering on the wafer can be reduced despite the inherent holding means if the holding means does not occupy the upper side space.

Therefore, it is an object of the present invention to provide a plating device for a wafer which employs a holding means which is not positioned above the wafer not only during non-plating process but also during plating process.

Therefore, the present invention employs as a holding means inherent for depressing a wafer an air bag which constrains only the upper surface of the circumferential edge of the wafer at an expanded state and releases the constraint by contracting to restore an initial configuration at a non-expanded state.

In further detail, the air bag is in a ring-shaped configuration corresponding to the configuration of the circumferential edge of the wafer and positioned at a position to constrain only the upper surface of the circumferential edge of the wafer at the expanded state and to be entirely retracted from the upper surface of the circumferential edge of the wafer upon contracting to restore the initial configuration.

By employing such an air bag as the holding means, it becomes possible to perform plating process for the wafer in a clean environment.

The above-mentioned and other objects, advantages, feature and application will become more clear from the following disclosure with reference to the accompanying drawings.

DESCRIPTION OF THE PREFERRED EMBODIMENT

The preferred embodiments will be discussed hereinafter with reference to the drawings.

Figure 1:
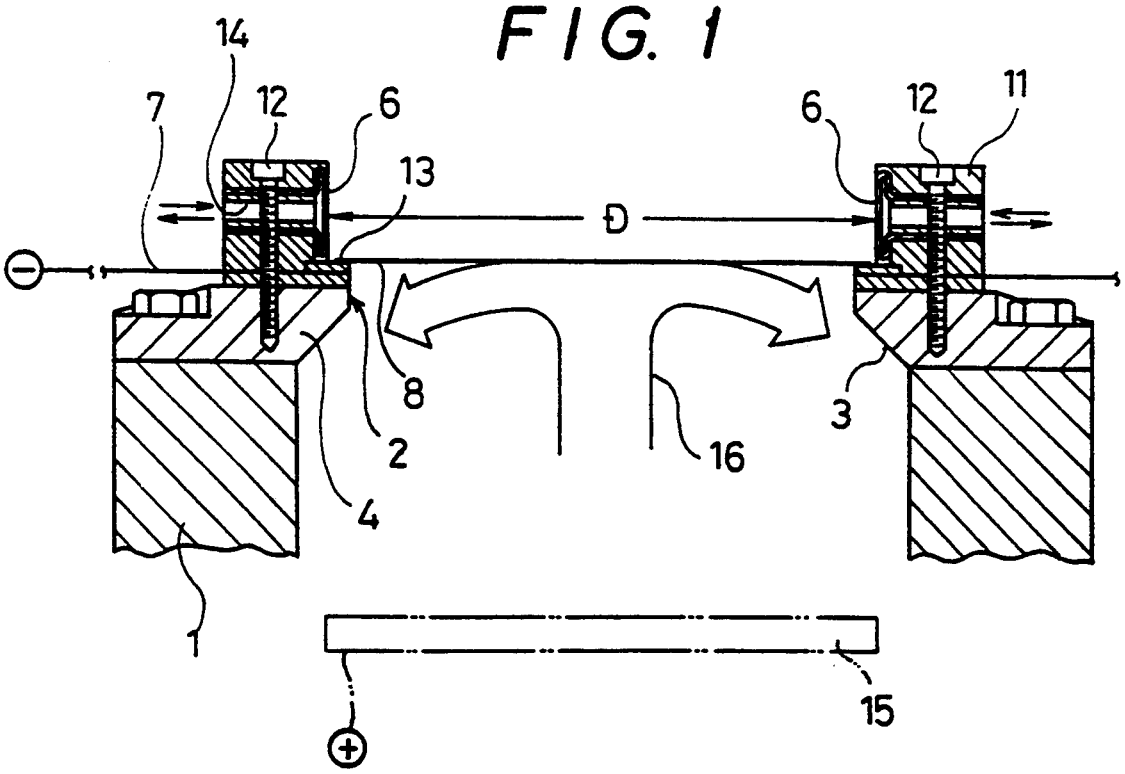
FIG. 1 is a sectional view of a major portion of a wafer plating device as one embodiment.
Figure 4:
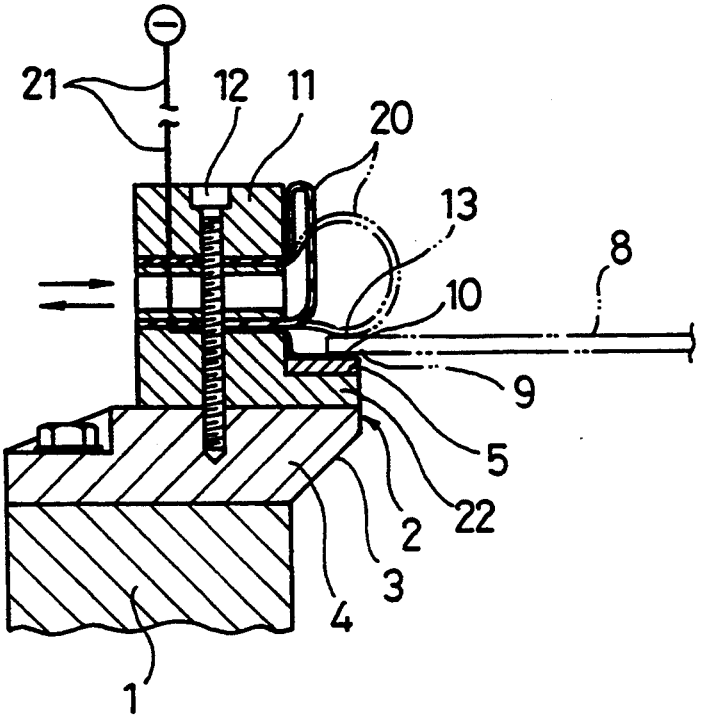
FIG. 4 is a partial enlarged sectional view of the second embodiment corresponding to FIG. 2.

It should be noted that in the disclosure hereabove and hereafter, the words expressing directions, such as "upper surface", "lower surface", "upward" and "downward", are used to represent the up and down direction in FIGS. 1 and 4. Therefore, when the device is oriented so that the vertical axis in FIG. 1 lies horizontally, the wording expressing the up and down directions should be understood to represent the left and right directions.

Figure 2:
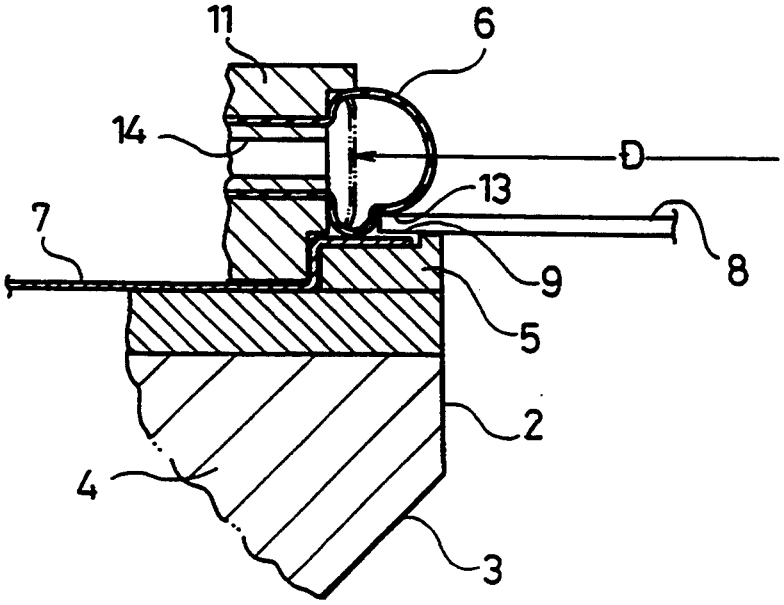
FIG. 2 is a partial enlarged sectional view showing an air bag in an expanded condition.
Figure 3:
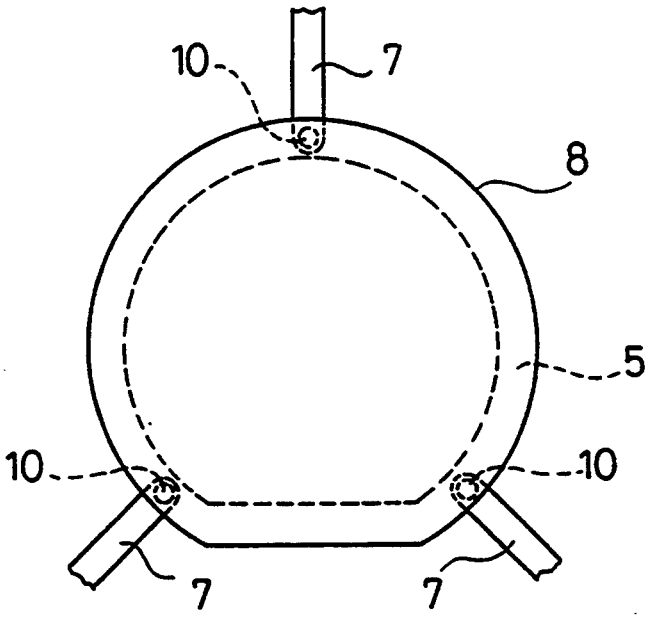
FIG. 3 is a plan view showing a positional relationship of the wafer and the cathode electrode.

FIGS. 1 to 3 show the first embodiment. FIG. 1 shows the major portion of a wafer plating device. As can be seen, an opening portion 2 and a positioning base portion 4 having a tapered surface 3 are provided at the upper portion of a box or cup shaped plating bath 1. An elastic member 5, an air bag 6 and cathode electrodes 7 are arranged above the positioned base portion 4.

The positioning base portion 4 and the elastic member 5 are respectively formed into ring shaped configuration and into sizes to receive thereon a lower surface 9 of the circumferential edge of a wafer 8. The cathode electrodes 7 have a thin flat configuration and are arranged at three positions as shown in FIG. 3. The tip ends 10 of the cathode electrodes 7 are mated with the upper surface of the elastic member 5 so that they may partially contact with the lower surface 9 of the circumferential edge of the wafer 8.

The air bag 6 is arranged above the positioning base portion 4. In practice, the air bag 6 is provided above the elastic member 5 at a position not interfering with wafer 8 upon setting and removing the latter. Namely, the position of the air bag 6 is selected so that it may not interfere with the wafer 8 when the wafer is mounted on the elastic member 5 or removed therefrom. A base 11 serves as a support for installing the air bag 6, and is rigidly secured on the positioning base portion 4 by means of a plurality of mounting bolts 12.

It should be noted that, in the disclosure hereabove and herebelow, the terminology of air as in "air" and "air bag" is used to broadly express gas phase substances, such as air, inert gas and so forth.

The air bag 6 is formed into generally annular ring shaped configuration and is provided a slightly greater internal diameter D than the external diameter of the wafer 8. The air bag 6 is positioned above the positioning base portion 4 and the elastic member 5 so that it may constrain only the upper surface of the circumferential edge of the wafer 8 as expanded and be retracted away from the upper surface 13 of the circumferential edge of the wafer as contracted to restore the original configuration. For expanding and contracting the air bag 6, air supplying and ventilating apertures 14 are formed at a plurality of positions.

It should be noted that, in the drawings, the reference numeral 15 denotes an anode electrode arranged within the plating bath 1, and the reference numeral 16 denotes a plating fluid flow.

For performing plating process for the wafer 8, the wafer 8 is placed horizontally on the elastic member 5 by means of a not shown transporting robot device so that the wafer 8 may be supported thereon. Then, air is supplied through the air supplying and ventilating apertures 14 to expand the air bag 6. The air bag 6 is thus expanded toward the center of the ring shape to slightly bulge inwardly so that only the upper surface 13 of the circumferential edge of the wafer 8 can be constrained by the air bag 6 and depressed. The air bag 6 is further expanded from the state of FIG. 2 to depress the upper surface 13 of the circumferential edge of the wafer 8 so that the lower surface 9 of the circumferential edge sealingly contacts with the elastic member 5. At this time, the lower surface 9 of the circumferential edge comes into contact with the cathode electrode 7 so that sufficient cathode current can be supplied to the wafer 8. Then, the cathode electrode 7 is buried in the upper surface of the elastic member 5 to that the periphery thereof may be sealed by the elastic member 5. The plating fluid flow 16 is applied to the lower surface of the wafer 8 with receiving supply of an anode ion from the anode electrode 15 for performing plating.

It should be noted that in the foregoing and following explanations, since the air supplied to the air bag 6 is regulated at a constant pressure, the air bag 6 may be expanded up to a predetermined expansion degree and cannot be expanded excessively.

The plating fluid flow 16 is injected toward the lower surface of the wafer 8 exposed through the opening portion 2 and does not contact with the lower surface 9 of the circumferential edge and falls down to the lower side of FIG. 2.

Namely, throughout the plating process, the circumferential edge of the wafer 8 are situated in a position sealingly clamped between the air bag 13 and the elastic member 5 at the upper and lower surfaces 13 and 9. Therefore, the plating fluid flow 16 will never enter between the upper and lower surfaces 13 and 9 of the wafer 8. Of course, the plating fluid flow will never leak to the upper surface of the wafer. Furthermore, the plating fluid flow 16 will never contact with the cathode electrode 7 sealed with the elastic member 5.

Once plating process is completed, air is vented through the air supply and ventilating apertures 14 to contract the air back to restore the initial configuration. Since the internal diameter D of the air bag 6 is slightly greater than the external diameter of the wafer 8, the wafer 8 can be easily removed upwardly from the elastic member 5 by the not shown transporting robot device by contraction and restoration of the initial configuration of the air bag 6.

As set forth, either during plating process state and non-plating process state, the air bag 6 will not occupy the space above the wafer to receive the upper side space of the wafer vacant.

Next, the second embodiment will be discussed with reference to FIG. 4. It should be noted that like elements to the first embodiment will be represented by like reference numeral so that redundant discussion can be avoided.

In the contracted position, an air bag 20 is provided with such a cross-sectional configuration that the upper side portion is primarily contracted. This configuration of the air bag is differentiated from that of the first embodiment, in which the air bag 6 is provided with a cross-sectional configuration to symmetrically contract at upper and lower side portions. With the shown cross-sectional configuration, the air bag 20 is expanded to lower the tip end to contact with the upper surface 13 of the circumferential edge of the wafer 8. This arrangement may further facilitates application of the depression force for the upper surface 13 of the circumferential edge of the wafer.

On the other hand, in the shown embodiment, cathode electrodes 21 are formed into thin wire shaped configurations. The cathode electrodes 21 are inserted through the base 11 from the upper surface and extended through the lower side of the air bag 20. The tip ends of the cathode electrodes 21 are exposed on the upper surface of the elastic member 5.

As set forth above, according to the present invention, although the holding means for depressing the wafer downwardly is employed, since the air bag which does not require substantial space, is employed as the holding means, the upper side space of the wafer will never be occupied by the holding means not only during non-plating state but also during plating state to maintain the upper side space vacant. Also, in comparison with the conventional pressure cylinder or the depression means used commonly as the electrode, the present invention does not require mechanical movable equipment so as to reduce the possibility of adhering dust or other foreign matters on the upper surface of the wafer. Therefore, the wafer plating device of the present invention is suitable for application in a clean room.

What is claimed is:

1. A plating device for plating a wafer in which the lower surface of the circumferential edge of said wafer is held by a holding means onto a positioning base portion formed in an opening portion of a plating bath and a plating fluid is applied onto the lower surface of said wafer for plating, characterized in that said holding means comprises an air bag which is adapted to constrain only the upper surface of the circumferential edge of said wafer at an expanded state and releases the constraint by contracting to restore an initial configuration at a non-expanded state; wherein the plating fluid includes a supply of anodically-charged ions and an elastic member is provided on said positioning base portion for receiving the lower surface of the circumferential edge of said wafer, and at least one cathode electrode that can partially contact with the lower surface of the wafer is mated with said elastic member.

2. A plating device for a wafer as set forth in claim 1, wherein said air bag is in a ring-shaped configuration corresponding to the configuration of the circumferential edge of said wafer and positioned at a position to constrain only the upper surface of the circumferential edge of said wafer at the expanded state and to be entirely retracted from the upper surface of the circumferential edge of the wafer upon contracting to restore the initial configuration.

3. In a plating device for plating a wafer supported on a positioning base portion, a holding means for selectively constraining the upper surface of a circumferential edge of the wafer so as to hold the wafer on the base, the holding means comprising an air bag that is expandable for selectively constraining only the upper surface of a circumferential edge of the wafer and contractible for selectively releasing the constraint and wherein an elastic member is provided on said positioning base portion for receiving the lower surface of the circumferential edge of said wafer.

4. A plating device for a wafer as set forth in claim 3, wherein said air bag is in a ring-shaped configuration corresponding to the configuration of the circumferential edge of said wafer and positioned at a position to constrain only the upper surface of the circumferential edge of said wafer at the expanded state and to be entirely retracted from the upper surface of the circumferential edge of the wafer upon contracting to restore the initial configuration.

5. A plating device for plating a wafer, the plating device comprising: a plating bath having an opening; a positioning base for supporting the wafer in the opening so that the lower surface of the wafer may be plated; and holding means for holding the wafer onto the positioning base, the holding means comprising an air bag that is expandable to constrain the upper surface of the wafer and contractible to release the constraint of the upper surface of the wafer, wherein the plating fluid includes a supply of anodically-charged ions and an elastic member is provided on said positioning base portion for receiving the lower surface of the circumferential edge of said wafer, and at least one cathode electrode which can partially contact with the lower surface of the wafer is mated with said elastic member.

6. A plating device for a wafer as set forth in claim 5, wherein said air bag is in a ring-shaped configuration corresponding to the configuration of the circumferential edge of said wafer and positioned at a position to constrain only the upper surface of the circumferential edge of said wafer at the expanded state and to be entirely retracted from the upper surface of the circumferential edge of the wafer upon contracting to restore the initial configuration.

* * * * *